US008035311B2

(12) United States Patent
Prexl et al.

(10) Patent No.: US 8,035,311 B2
(45) Date of Patent: Oct. 11, 2011

(54) LIGHT-EMITTING SEMICONDUCTOR DEVICE DRIVER AND METHOD

(75) Inventors: Franz Prexl, Oberding (DE); Erich-Johann Bayer, Thonhausen (DE); Juergen Neuhaeusler, Bad Aibling (DE)

(73) Assignee: Texas Instruments Deutschland GmbH, Freising (DE)

( * ) Notice: Subject to any disclaimer, the term of this patent is extended or adjusted under 35 U.S.C. 154(b) by 613 days.

(21) Appl. No.: 12/204,615

(22) Filed: Sep. 4, 2008

(65) Prior Publication Data

US 2009/0072755 A1 Mar. 19, 2009

Related U.S. Application Data

(63) Continuation-in-part of application No. PCT/EP2008/060766, filed on Aug. 15, 2008.

(60) Provisional application No. 61/016,762, filed on Dec. 26, 2007.

(30) Foreign Application Priority Data

Aug. 17, 2007 (DE) ..... 10 2007 038 892

(51) Int. Cl.
*G04F 1/00* (2006.01)

(52) U.S. Cl. ..... 315/291; 315/224; 315/299; 315/225; 315/226; 315/307; 315/308; 315/209 R

(58) Field of Classification Search ..... 315/209 R, 315/185 S, 224, 225, 226, 291–311
See application file for complete search history.

(56) References Cited

U.S. PATENT DOCUMENTS

| | | | | |
|---|---|---|---|---|
| 6,400,101 | B1 * | 6/2002 | Biebl et al. | 315/291 |
| 6,734,639 | B2 * | 5/2004 | Chang et al. | 315/291 |
| 2004/0251854 | A1 * | 12/2004 | Matsuda et al. | 315/291 |
| 2005/0057189 | A1 * | 3/2005 | Kimura | 315/291 |
| 2005/0185428 | A1 | 8/2005 | Crawford et al. | |
| 2005/0231133 | A1 | 10/2005 | Lys | |
| 2006/0197720 | A1 | 9/2006 | De Oto et al. | |
| 2007/0013323 | A1 | 1/2007 | De Oto | |
| 2009/0167200 | A1 * | 7/2009 | Brokaw et al. | 315/224 |

FOREIGN PATENT DOCUMENTS

| | | |
|---|---|---|
| DE | 199 30 174 | 6/1999 |
| WO | WO 03/017729 | 2/2003 |
| WO | 2004/100614 | 11/2004 |

* cited by examiner

*Primary Examiner* — Douglas W Owens
*Assistant Examiner* — Amy Yang
(74) *Attorney, Agent, or Firm* — John J. Patti; Wade J. Brady, III; Frederick J. Telecky, Jr.

(57) ABSTRACT

An electronic device includes circuitry for driving a light-emitting diode (LED) or other light-emitting semiconductor device. The circuitry includes a first switch (NM5) coupled with the light-emitting semiconductor device (LED) for switching a current ($I_{LED}$) through the light-emitting semiconductor device (LED); a sensing means ($R_{SENS}$) for sensing a magnitude of the current ($I_{LED}$) and outputting a respective sensing signal (SEN); an error amplifier (AMP2) for receiving the sensing signal (SEN) and a target value (ISET) for the current ($I_{LED}$) for providing a first control voltage (VG1) based on the deviation of the actually sensed current magnitude and the current target value (ISET); a lowpass filter coupled to the error amplifier (AMP2) for filtering the first control voltage (VG1) and providing a second control voltage (VG2); a voltage follower (NM3) coupled to the lowpass filter and the first switch for receiving the second control voltage (VG2) and providing a third control voltage (VG3) for controlling the first switch's (NM5) switching activity; and a second switch (PM1, NM4) for switching a supply current (IDS3) of the voltage follower (NM3) for switching the voltage follower (NM3) on and off.

16 Claims, 1 Drawing Sheet

FIG. 1
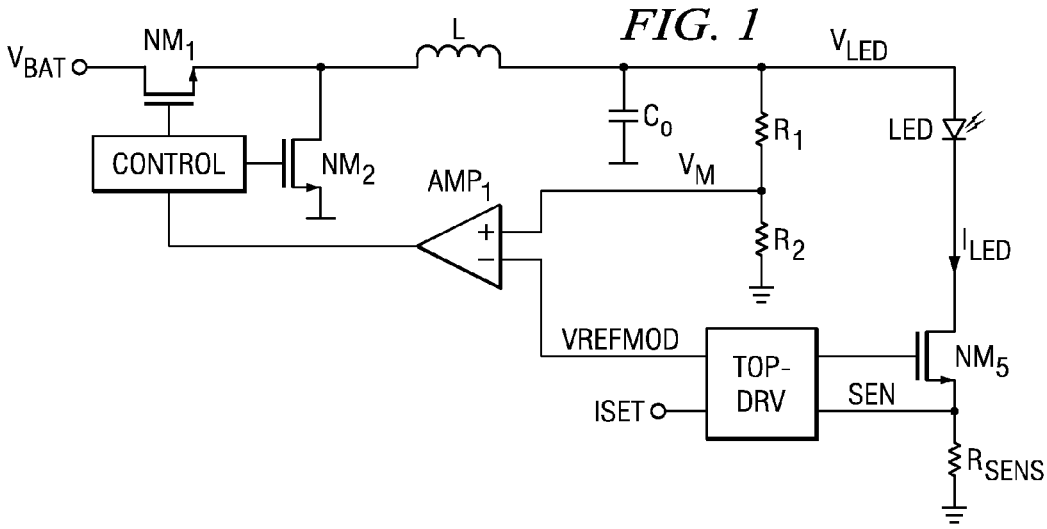
FIG. 2
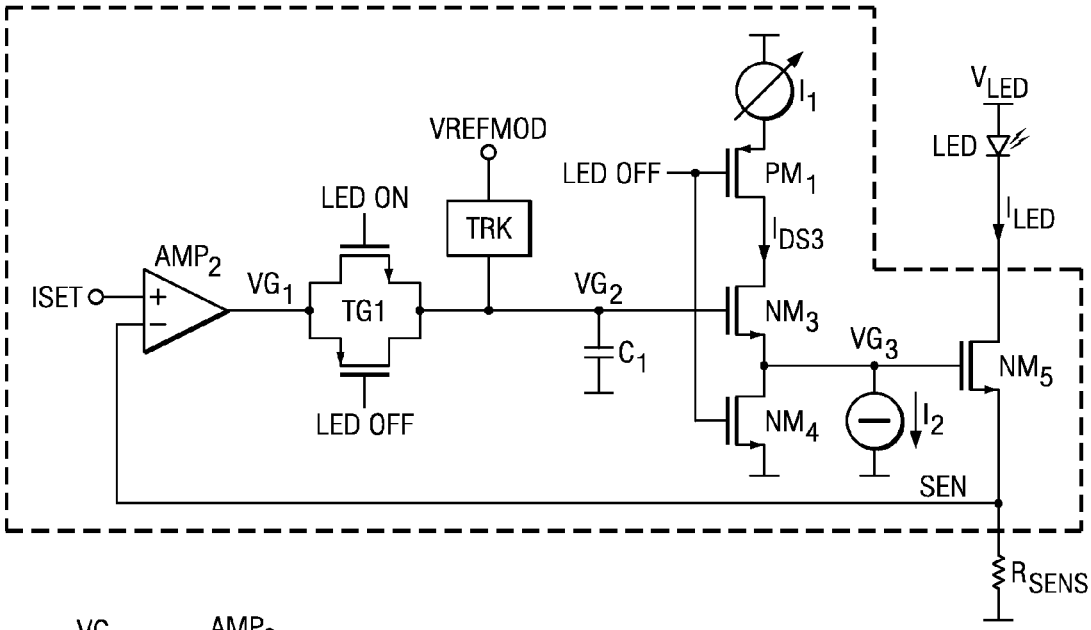
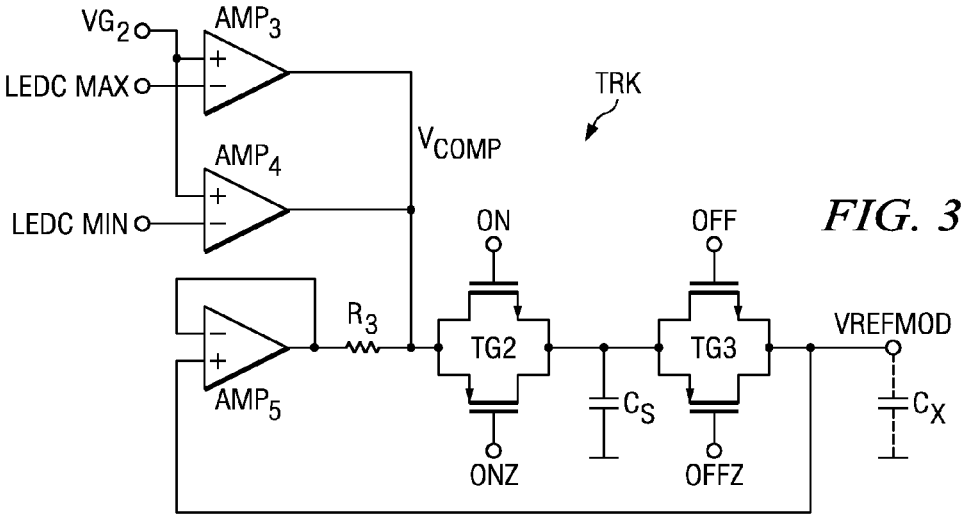
FIG. 3

LIGHT-EMITTING SEMICONDUCTOR DEVICE DRIVER AND METHOD

This application is a continuation-in-part of PCT/EP2008/060766 filed 15 Aug. 2008, which claims priority from German Patent Application No. 10 2007 038 892.0, filed 17 Aug. 2007; and this application also claims priority from U.S. Provisional Patent Application No. 61/016,762, filed 26 Dec. 2007; the entireties of which are incorporated herein by reference.

FIELD OF THE INVENTION

The invention relates to an electronic device for driving a light-emitting semiconductor device, and a corresponding method.

BACKGROUND

As light projecting systems and television devices become more and more sophisticated, there is a general desire to achieve a high-power conversion efficiency. Therefore, light-emitting semiconductor devices such as, for example, light-emitting diodes (LED), are used as light sources. There are various different ways to produce grey scale or color pictures based on highly sophisticated and miniaturized optical light-guiding means that are electrically controlled. One example is the use of a digital micro mirror device (DMD) for light projection, such as that based on the DLP® technology of Texas Instruments. DMD-based technologies, and also other light projecting technologies, need very fast switching light-emitting semiconductor devices in order to display pictures according to current quality standards. However, conventional architectures and circuits used for switching LEDs fail to provide sufficiently precise and quick switching behavior.

SUMMARY

It is an object of the invention to provide an electronic device for driving light-emitting semiconductor devices, which allows fast and precise switching of the light-emitting semiconductor devices with a relatively low power consumption.

According to a first aspect of the invention, an electronic device including circuitry for driving a light-emitting semiconductor device is provided. In a described embodiment, the circuitry includes a first switch coupled for switching a current through the light-emitting semiconductor device. There is a sensing means for sensing a magnitude of the current and for outputting a respective sensing signal. An error amplifier receives the sensing signal and a preset target value relating to the desired current. The error amplifier is adapted to provide a first control voltage based on the deviation of the current's actually sensed magnitude of the current and the preset target value. A lowpass filter is coupled to the error amplifier for filtering the first control voltage and for thereby providing a second control voltage. A voltage follower is coupled to the lowpass filter and the first switch for receiving the second control voltage and providing a third control voltage for controlling the switching activity of the first switch. Advantageously, a second switch is provided for switching a supply current of the voltage follower for switching the voltage follower on and off.

According to this first aspect of the invention, the first switch is controlled in a rather indirect manner by switching a voltage follower on and off, which in turn receives a specific second control voltage at the input. The second control voltage at the input of the voltage follower is buffered by a lowpass filter, which means that the second control voltage varies only slowly compared to the switching activity of the first switch and the voltage follower. Accordingly, it is possible to switch the first switch very quickly by switching the voltage follower on and off, thereby achieving a very precise target value for the third control voltage, as the third control voltage is produced by the voltage follower on the basis of the second control voltage, which is maintained during the switching activity. The voltage follower can be dimensioned to settle quickly and precisely. This allows the light-emitting semiconductor device to be controlled in a much more precise and quick way compared with the prior art.

The first switch may advantageously be a transistor. Thus, the first switch may provide a switching means that can be gradually opened rather than just having two states. Thus, a precise third control voltage level may be provided, which is applied to a control input of the transistor (e.g., the gate of a MOSFET or the base of a bipolar transistor), so as to establish a precisely determined amount of current through the switching device.

Any architecture of a lowpass filter may be used. Advantageously, the lowpass filter includes a buffering capacitor for buffering the second control voltage at the input of the voltage follower, and a third switch which is coupled between the output of the voltage generator and the first buffering capacitor. The buffering capacitor serves to maintain the second control voltage at the input of the voltage follower and thereby provides a low pass filtering characteristic with respect to fast changes of the voltage level at this node. In order to decouple the input of the voltage follower from undesired changes, a third switch is provided that can disconnect the input of the buffered input voltage node of the voltage follower from the error amplifier's output.

Further, the second switch and the third switch may be arranged to be alternately switched on and off with respect to each other, and such that the second control voltage on the buffering capacitor is only coupled to the error amplifier when the light-emitting semiconductor device is on. The second control voltage is controlled in such a way that a specific behavior (e.g., a specific luminance or intensity of the emitted light) of the light-emitting semiconductor device is achieved. The amount of current flowing through the light-emitting semiconductor device can be determined only while the semiconductor device is turned on. This is the right moment to update or to refresh the second control voltage on the buffering capacitor through the error amplifier. However, when the light-emitting semiconductor device is switched off, i.e., the voltage follower is switched off, the voltage on the buffering capacitor is substantially frozen and maintained. Thereby, a decoupled second control voltage is provided that changes only rather slowly.

In order to further improve the switching behavior, a constant current source may be coupled to the first switch. This is particularly useful if the first switch is a transistor, for example, a MOSFET. The constant current source may then be used to rapidly discharge the gate of the MOSFET transistor in order to increase the switching speed. The voltage follower can include a MOSFET transistor, i.e., it can, for example, be implemented by use of a single MOSFET. In this situation, the supply current, which is switched in order to turn the voltage follower on and off, can be the drain current through the MOSFET transistor. The electronic device can then include a programmable current source coupled to the MOSFET transistor in order to flexibly adjust the drain current. This configuration allows the rise and fall times, i.e., the switching speed of the voltage follower, to be adjusted flexibly, for example by using configuration commands.

The light-emitting semiconductor device may further be coupled to a regulated voltage supply, which could be be any switch mode power converter as, for example, a boost converter or a buck converter. In this case, a tracking stage can be provided which is coupled to the input of the voltage follower, i.e., to the second control voltage, in order to determine the voltage level of the second control voltage. The tracking stage can then be adapted to adjust the supply voltage level of the regulated voltage supply for the light-emitting semiconductor device through a modulation control signal (e.g., a voltage level) so as to minimize a voltage drop across the first switch in an ON-phase of the light-emitting semiconductor device. This configuration ensures that the first switch is opened far enough in order to provide sufficient current through the light-emitting semiconductor device with a minimum voltage drop cross the switch. This aspect of the invention takes account of power losses in the switch, which are to be minimized.

According to another aspect of the invention, the electronic device may include multiple circuitry for driving a light-emitting semiconductor device, so as to drive a plurality of light-emitting semiconductor devices. Each such driving stage can then be coupled through the same or several tracking stages to a regulated power supply for tracking the supply voltage for each of the plurality of semiconductor devices. This is particularly useful for a plurality of light-emitting semiconductor devices, such as for example a red, a green, and a blue LED, if the light-emitting devices are only switched alternately or consecutively, such that two of them are never switched on at the same time. This allows the supply voltage level to be adapted to a plurality of devices by use of the same mechanism.

The tracking stage can further comprise a window comparator for comparing whether or not the second control voltage lies within a target window of a maximum voltage level and a minimum voltage level and for providing a comparator output voltage in accordance with the comparison result. The comparator output voltage can be sampled during an ON-phase of the light-emitting semiconductor device (i.e., during a period of time during which the light-emitting semiconductor device emits light) on a sampling capacitor. The sampled comparator output voltage can then be used for refreshing the modulation control voltage. Further, the tracking stage can be adapted such that the modulation control voltage is only refreshed during an OFF-phase of the light-emitting semiconductor device. Advantageously, the period of time for sampling comparator output voltage on the sampling capacitor and the period of time for refreshing the modulation control voltage are non-overlapping clock periods. This allows a smooth and stepwise adjustment of the modulation control signal, which in turn controls the supply voltage level to an optimum level. Further, the updating of the modulation control signal occurs only during the OFF-phase of the light-emitting semiconductor device, which prevents disturbances.

In another aspect, the invention also provides a method for driving a light-emitting semiconductor device. In an example embodiment, a current through the light-emitting semiconductor device is switched and sensed. Then a deviation of the sensed current from a preset target value is determined and a first control voltage for adjusting the current in accordance with the determined deviation is provided. The first control voltage is filtered with a lowpass filtering means, so as to provide a smoothed second control voltage. The second control voltage is then buffered with a voltage follower so as to provide a third control voltage, which serves for controlling the first switch. Eventually, the voltage follower is turned on and off, so as to apply or not to apply the third control voltage to the switch thereby switching the first switch on and off. The second control voltage is updated by use of the first control voltage, but only when the light-emitting semiconductor is switched on.

The light-emitting semiconductor device is preferably a light-emitting diode (LED), but the above-described aspects of the invention can also be advantageously applied to a laser or other light-emitting semiconductor devices which are to be switched rapidly.

BRIEF DESCRIPTION OF THE DRAWINGS

Further features and advantages of the invention will become apparent from the following description of example embodiments, with reference to the accompanying drawings, wherein:

FIG. 1 shows a simplified circuit diagram of an example embodiment incorporating principles of the invention;

FIG. 2 shows a simplified circuit diagram of an example control stage TOP-DRV circuit of FIG. 1; and FIG. 3 shows a simplified circuit diagram of an example tracking stage TRK of FIG. 2.

DETAILED DESCRIPTION OF EXAMPLE EMBODIMENTS

FIG. 1 shows an example light-emitting semiconductor device comprising a light-emitting diode (LED) having one side coupled to a source of regulated supply voltage $V_{LED}$. The regulated voltage supply is shown as a buck converter, but other switch mode power supplies may be used. The other side of the LED is coupled to an NMOS transistor NM5 which is in series with a sense resistor $R_{SENS}$. The NMOS transistor NM5 is used as a switch in order to switch the current $I_{LED}$ through the LED. Further, a resistive divider R1, R2 is used to monitor the supply voltage $V_{LED}$ and to provide a monitoring voltage $V_M$, which is fed to an error amplifier AMP1 that generates an output signal for a control stage CONTROL. The control stage CONTROL provides control signals to NMOS transistors NM1 and NM2 in order to control the voltage conversion from a primary supply voltage $V_{BAT}$ and the LED supply voltage $V_{LED}$. Transistors NM1, NM2, the CONTROL stage, an inductor L and a capacitor $C_0$ constitute a regulated voltage supply. They are configured as a buck converter, but a boost converter or a buck/boost converter architectures may also be used. In order to provide a fast on and off switching behavior of the LED, a stage TOP-DRV is provided. The current through the LED is set by a value ISET, which indicates the current $I_{LED}$ through the LED, if the LED is switched on. In order to provide sufficiently quick switching and low power consumption, the control stage TOP-DRV is implemented as shown in FIG. 2.

FIG. 2 illustrates an example embodiment of the control stage. The NMOS transistor NM5 is used as the switch for switching the current $I_{LED}$ through the LED. An error amplifier AMP2 compares the sensed voltage drop SEN across the sense resistor $R_{SENS}$ with a preset target voltage level ISET and outputs a corresponding first control voltage VG1. In the shown configuration, error amplifier AMP2 receives a positive input voltage ISET at its positive input and the sensing voltage level SEN at its negative input. The input voltage ISET is chosen so as to achieve a target value for the current $I_{LED}$ through the LED, during the ON-phase of the LED. The current $I_{LED}$ can be determined based on the luminance or brightness that the LED should provide. A switch TG1 (in this case a transfer gate) is coupled between the output of the error amplifier AMP2 and an input of a voltage follower, which comprises an NMOS transistor NM3. TG1 serves to decouple the error amplifier output from the voltage follower NM3 input (i.e., the gate of NM3). The gate voltage of NM3 is buffered by a buffering capacitor C1, which provides in combination with the switched transfer gate TG1 a smoothing and lowpass function. However, other implementations having a lowpass characteristic may be used.

A programmable current source I1 is coupled to NM3 through a PMOS transistor PM1. Also, a NMOS transistor NM4 is coupled between the source of NM3 and ground. The first control voltage VG1 is applied to the transfer gate TG1 and the transfer gate TG1 applies a second control voltage VG2 to the gate of NM3. A third control voltage VG3 based on the second control voltage VG2 and controlled through the voltage follower NM3 is developed at the source of NM3 and applied to the gate of NM5.

During operation, the transistors PM1 and NM4 are used to switch the current through transistor NM3 on and off. There are control signals LED ON and LED OFF coupled to the transfer gate TG1 and to the switching transistors PM1, NM4. If the control signal LED ON is logic high, the transfer gate TG1 opens and VG2 is updated by the output voltage VG1 of the error amplifier AMP2. Thus the sensing signal SEN is only compared to the preset target value ISET while current is flowing through transistor NM5 and resistor $R_{SENS}$. The second control voltage VG2 is then fed to transistor NM3, which is dimensioned and biased so as to provide an appropriate value of the third control voltage at its source, when the control signal LED OFF is low, i.e., during an ON-phase of the LED. Also, PM1 and the programmable current source I1 are dimensioned so as to achieve the appropriate voltage levels and short rise times. If the control signal LED OFF is high, i.e., the LED should be off, NM4 is open and pulls down the gate of NM5. The pulling down effect can be supported by the constant current source I2, coupled to node VG3. Advantageously, the constant current source I2 sinks less current than provided through the programmable current source I1, i.e., the magnitude of that sunk by the constant current source I2 is smaller than the magnitude of the supply current $I_{DS3}$ of the transistor NM3. Therefore, if PM1 is open, i.e., the control signal LED OFF is low, the control voltage VG3 is immediately pulled up to a level basically determined by VG2. Since the second control voltage VG2 is maintained during the OFF-period of the LED, the voltage follower can settle almost immediately. A constant and precise third control voltage level VG3 is then applied to the gate of NM5. By increasing IDS3 the rise time can be increased.

The control loop reaching from NM5, through $R_{SENS}$, AMP2, TG1, C1, and NM3 must be dimensioned so as to be stable. Self-excitation or oscillations have to be avoided and an appropriate settling behavior should be provided. As an example only, the components can have the following properties. The amplifier AMP2 can have a limited transconductance of 10 μS. Further, the capacitor C1 can have a capacitance of 100 pF, the current from the constant current source I2 can amount to 10 μA, and the programmable current source I1 can be set to 50 μA. The sense resistor $R_{SENS}$ can have a resistance of 50 mΩ. This can allow a maximum LED current $I_{LED}$ of about 2A with a maximum voltage drop across the sense resistor $R_{SENS}$ of 100 mV. If the buffering capacitor C1 is chosen to be sufficiently large, the output of the low pass filter keeps the voltage level of the second control voltage basically constant while the LED is switched off. Accordingly, the next activation of the switch (switching transistor NM5 on) can be very fast. The turn on time is only limited by the programmable current source I1.

A tracking stage TRK is coupled to the node VG2 and outputs a control voltage VREFMOD. The functionality and implementation of an example tracking stage is described with reference to FIG. 3. A window comparator comprising amplifiers AMP3, AMP4 determines whether or not the second control voltage VG2 is within the voltage range defined by LEDCMAX and LEDCMIN. The amplifiers AMP3, AMP4 are preferably transconductance amplifiers. The output of the window comparator is coupled to a closed loop configuration wherein a sampling capacitor $C_S$ is enclosed by two switches (or transfer gates) TG2 and TG3, which are alternately activated. The control signals ON, ONZ, OFF, OFFZ are non-overlapping clock signals, which can be derived from LED ON and LED OFF (already discussed in connection with FIG. 2). So, ON is high during an ON-period of the LED, i.e., when the LED emits light. OFF is high during an OFF-period of the LED, i.e., while the LED is switched off. The character Z indicates the complementary signal. The amplifier AMP5 is connected as a voltage follower. LEDC MAX and LEDC MIN are typically set to voltage levels close to $V_{LED}$, which is the internal supply voltage for the LED. For example, LEDC MAX=$V_{LED}$−0.5 V and LEDC MIN=$V_{LED}$−1 V. The amplifiers AMP3, AMP4 can have a limited transconductance of 100 μS and a maximum current drive capability of 10 μA. Resistor R3 may be 25 kΩ.

When VG2 is below LEDC MIN, both (e.g., transconductance) amplifiers AMP3 and AMP4 sink current, which results in a voltage drop across R3 from the output of AMP5 to $V_{COMP}$. When VG2 is above LEDC MIN and below LEDC MAX, AMP4 drives current into node $V_{COMP}$ while AMP3 still sinks current from node $V_{COMP}$ which results in no voltage drop across R3, since both currents cancel each other. When VG2 is above LEDC MAX, both amplifiers AMP3 and AMP4 drive current into the output of AMP5, which results in a negative voltage drop across R5 from the output of AMP5 to $V_{COMP}$.

While the LED is on, the sampled voltage on buffering capacitor C1 (i.e., VG2 shown in FIG. 2) is compared with a voltage window defined by LEDC MIN and LEDC MAX. As long as this second control voltage VG2 is lower than LEDC MIN, the switch impedance (while switched on) is not yet as low as possible. When the second control voltage VG2 reaches the lower level of the voltage window LEDC MIN, the impedance of transistor NM5 (shown in FIG. 2) in the ON-state is correct and no further optimization is required. If the second control voltage VG2 raises above LEDC MAX, the switch NM5 has reached the lowest possible impedance, which means that the current regulation is close to or at its limit. In this case, the DC-DC converter (buck converter shown in FIG. 1) is prompted to increase the LED supply voltage $V_{LED}$ by raising the control voltage VREFMOD. If the second control voltage VG2 is lower than LEDC MIN, VREFMOD is lowered until the second control voltage VG2 reaches the required minimum level LEDC MIN. The general approach involves charging the sampling capacitor $C_S$ with a lower voltage than the actual voltage level of VREFMOD. As long as the second control voltage remains within the voltage window defined by LEDC MIN and LEDC MAX, the capacitor $C_S$ is charged with the actual value of the control voltage VREFMOD. When the LED is switched off, the small capacitor $C_S$ is connected to a larger capacitance $C_X$ storing the actual value of the control voltage VREFMOD. Connecting capacitors $C_S$ and $C_X$ entails a charge redistribution between the two capacitors and VREFMOD is increased. This allows a stepwise modification of the control voltage VREFMOD.

Within the voltage window defined by LEDC MIN and LEDC MAX, and the control voltage VREFMOD remains stable.

Those skilled in the art will appreciate that many other embodiments and variations are also possible within the scope of the claimed invention. Embodiments having different combinations of one or more of the features or steps described in the context of example embodiments having all or just some of such features or steps are also intended to be covered hereby.

What is claimed is:

1. An electronic device comprising circuitry for driving a light-emitting semiconductor device, the circuitry comprising:

a first switch coupled with the light-emitting semiconductor device for switching a current through the light-emitting semiconductor device;

a sensor for sensing a magnitude of the current and outputting a respective sensing signal;

an error amplifier coupled to receive the sensing signal and to provide a first control voltage based on the deviation of the sensed current magnitude and a current target value;

a lowpass filter coupled to the error amplifier for providing a filtered second control voltage based on the first control voltage;

a voltage follower coupled to receive the filtered second control voltage from the lowpass filter and to provide a third control voltage for controlling the switching of the first switch; and a second switch for switching on and off a supply current to the voltage follower.

2. The electronic device of claim 1, wherein the lowpass filter comprises a first buffering capacitor for buffering the second control voltage at an input of the voltage follower, and a third switch coupled between an output of the error amplifier and the first buffering capacitor.

3. The electronic device of claim 2, wherein the second switch and the third switch are arranged to be alternately switched on and off with respect to each other, such that the second control voltage on the buffering capacitor is only coupled to the error amplifier when the light-emitting semiconductor device is on.

4. The electronic device of claim 1, wherein the first switch is a MOSFET transistor, and a constant current source is coupled to the gate of the MOSFET transistor.

5. The electronic device claim 1, wherein the voltage follower comprises a MOSFET transistor and the supply current is a drain current through the MOSFET transistor; and the electronic device further comprises a programmable current source coupled to the MOSFET transistor configured to flexibly adjust the drain current.

6. The electronic device of claim 1, further comprising a tracking stage coupled to the input of the voltage follower for tracking the second control voltage and for controlling a supply voltage level of a regulated voltage supply for the light-emitting semiconductor device through a modulation control voltage so as to minimize a voltage drop across the first switch in an ON-phase of the light-emitting semiconductor device.

7. The electronic device of claim 6, wherein the tracking stage comprises a window comparator adapted for comparing whether or not the second control voltage lies within a target window of a maximum voltage level and a minimum voltage level, and for providing a comparator output voltage in accordance with the comparison result; wherein the comparator output voltage is sampled during an ON-phase of the light-emitting semiconductor device on a sampling capacitor, and the sampled comparator output voltage is used for refreshing the modulation control voltage.

8. The electronic device of claim 7, wherein the tracking stage is further adapted such that the modulation control voltage is only refreshed during an OFF-phase of the light-emitting semiconductor device.

9. The electronic device of claim 8, wherein the tracking stage is further adapted such that the period of time for sampling the comparator output voltage on the sampling capacitor and the period of time for refreshing the modulation control voltage are non-overlapping.

10. The electronic device of claim 9, further comprising multiple stages of the circuitry for driving the light-emitting semiconductor device, so as to drive a plurality of light-emitting semiconductor devices; wherein each such driving stage is coupled through the tracking stage to a regulated power supply for tracking the supply voltage for each of the plurality of semiconductor devices.

11. The electronic device of claim 6, wherein the lowpass filter comprises a first buffering capacitor for buffering the second control voltage at an input of the voltage follower, and a third switch coupled between an output of the error amplifier and the first buffering capacitor.

12. The electronic device of claim 11, wherein the second switch and the third switch are arranged to be alternately switched on and off with respect to each other, such that the second control voltage on the buffering capacitor is only coupled to the error amplifier when the light-emitting semiconductor device is on.

13. The electronic device of claim 12, wherein the first switch is a MOSFET transistor, and a constant current source is coupled to the gate of the MOSFET transistor.

14. The electronic device claim 13, wherein the voltage follower comprises a MOSFET transistor and the supply current is a drain current through the MOSFET transistor; and the electronic device further comprises a programmable current source coupled to the MOSFET transistor configured to flexibly adjust the drain current.

15. A method for driving a light-emitting semiconductor device, the method comprising:

switching a current through the light-emitting semiconductor device;

sensing a current through the light-emitting semiconductor device;

determining a deviation of the sensed current from a target value;

providing a first control voltage for adjusting the current in accordance with the determined deviation;

filtering the first control voltage with a lowpass filter, so as to provide a smoothed second control voltage;

buffering the second control voltage with a voltage follower so as to provide a third control voltage;

using the third control voltage for controlling the first switch; and switching the voltage follower on and off, so as to apply or not to apply the third control voltage to the switch, thereby switching the first switch on and off.

16. The method of claim 15, further comprising the step of updating the second control voltage by use of the first control voltage only when the light-emitting semiconductor is on.

* * * * *